US006550440B1

(12) United States Patent
Vrsek et al.

(10) Patent No.: US 6,550,440 B1
(45) Date of Patent: Apr. 22, 2003

(54) ACOUSTIC SUPPRESSION ARRANGEMENT FOR A COMPONENT UNDERGOING INDUCED VIBRATION

(75) Inventors: Gary Allan Vrsek, Brighton, MI (US); Bruce Joseph Tobis, Farmington Hills, MI (US); Furqan Zafar Shaikh, Troy, MI (US); Ken Steven Fedeson, Farmington Hills, MI (US); Kevin V. Tallio, Saline, MI (US); Alexander Slocum, Bow, NH (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/683,553

(22) Filed: Jan. 17, 2002

(51) Int. Cl.[7] ..... F02M 35/10

(52) U.S. Cl. ..... 123/184.61; 123/90.38; 123/195 C

(58) Field of Search ..... 123/184.61, 90.38, 123/195 C, 195 H; 184/106

(56) References Cited

U.S. PATENT DOCUMENTS

| | | | | |
|---|---|---|---|---|
| 3,504,762 A | | 4/1970 | Valbjorn et al. | 181/40 |
| 3,640,357 A | | 2/1972 | Kitching et al. | 181/33 |
| 4,048,366 A | | 9/1977 | Kingsbury | 428/215 |
| 4,393,830 A | | 7/1983 | Bodine | 123/272 |
| 5,467,747 A | | 11/1995 | Brandt et al. | 123/198 |
| 5,531,196 A | * | 7/1996 | Clark | 123/195 C |
| 5,852,991 A | * | 12/1998 | Yamamura et al. | 123/195 C |
| 6,085,709 A | | 7/2000 | Freese | 123/90.38 |

FOREIGN PATENT DOCUMENTS

| | | |
|---|---|---|
| JP | 0206961 | 10/1985 |

* cited by examiner

*Primary Examiner*—Tony M. Argenbright
*Assistant Examiner*—Katrina B. Harris
(74) *Attorney, Agent, or Firm*—Dykema Gossett; Carlos L. Hawee

(57) ABSTRACT

An acoustic suppression arrangement 7 for a component undergoing induced vibration is provided. The arrangement 7 includes a component body 8 having an interior surface 9 and an exterior surface 11 having a panel portion 20. A containment plate 24 is provided having a spaced relationship from the panel portion. A first projector 25 is connected to the component body panel portion 20 and extends toward the containment plate 24. A second projector 30 is connected to the containment plate. A connector system 39, 45 is provided to connect the containment plate 24 to the component body 8 while placing the first and second projectors 25, 30 in an interference fit. Vibratory energy of the component body 8 is dissipated by frictional contact between the projectors 25, 30.

27 Claims, 6 Drawing Sheets

ACOUSTIC SUPPRESSION ARRANGEMENT FOR A COMPONENT UNDERGOING INDUCED VIBRATION

BACKGROUND OF INVENTION

The present invention relates to suppression of audible noises generated by mechanical components and, in particular, to suppression of noises generated by automotive vehicle engine components that are fabricated from metal or polymeric materials.

In the most recent three decades there has been a major push to increase the fuel economy of automotive vehicles. One technical trend to increase automotive fuel economy is to provide port, fuel-injected V6 or in-line, four-cylinder engines instead of the previously popular carbureted V8 engines. Another technical trend is to make the vehicle lighter. An excellent example of an automotive component that has been made lighter is the engine. Engine blocks are now typically fabricated from cast aluminum rather than prior cast iron. Additionally, many components such as the intake manifold, valve covers and oil pan are now formed from polymeric materials such as plastics which can withstand high temperatures and which can be injected or blow molded.

Polymeric manifolds have several advantages over prior cast aluminum or iron intake manifolds. Polymeric manifolds do not require as much finish machining or deburring and they also enhance the energy efficiency of the vehicle because they are lighter than their prior metallic counterparts. Polymeric manifolds can also be formed for production vehicles with smoother inner surfaces providing greater control of the incoming airflow and an improved volumetric efficiency of the engine.

However, polymeric manifolds have certain disadvantages. One disadvantage is that they have a tendency to be more susceptible to forced vibration than aluminum or cast iron manifolds. Accordingly, the use of polymeric materials has resulted in manifolds with undesirable noise characteristics, which is particularly disturbing on a premium vehicle where noise reduction is expected. Other polymeric engine components with relatively large flat surfaces have the same potential noise disadvantage.

It is desirable to provide an arrangement and method of utilization of a mechanical component (especially an engine component) subject to induced vibration (a generator of noise), that can be fabricated from a polymeric material and still have the desired acoustic damping characteristics of prior mechanical components fabricated from metallic material.

SUMMARY OF INVENTION

In a preferred embodiment, the present invention brings forth an automotive engine component such as an intake manifold which is fabricated from a polymeric material such as a fiber reinforced resin plastic. The component body has a panel portion on its exterior surface. Projecting from the panel portion are parallel spaced dual linear first and third projectors. Parallel spaced away from the panel portion is a sonic containment plate. The sonic containment plate on a side toward the main body of the intake manifold has a series of second linear projectors with angled surfaces that are received between the spacing of first and third projectors on the intake manifold. Both the containment plate and the manifold panel portion have interlocking hook members to allow the containment plate to have a flexible snap fit sealed connection to the main body of the intake manifold along the perimeter of the containment plate.

The first and third projectors are preferably placed on the portion of the manifold having maximum vibratory amplitude, and will accordingly stiffen the manifold, while retaining the weight advantage of the polymeric material over prior metal manifolds. The stiffening provided by the projectors will help reduce or eliminate lower frequency modes of vibration. Additionally, the containment plate defines an enclosed space which contains the air set forth in motion by the vibration of the manifold. The containment plate is therefore a barrier to sound transmission.

The flexible snap fit connection of the containment plate and the interference fit frictional engagement of the first and third projectors connected to the manifold body and the second projectors connected to the containment plate provide frictional damping to attenuate any vibratory energy (noise) generated by the intake manifold. Accordingly, less vibration is transmitted to the air surrounding the intake manifold.

Damping of a component can be obtained by one of four means: internal losses in a material, added viscoelastic material layers, added mechanism, e.g., tuned mass dampers, or microslip in joints. The latter is actually what provides most damping in most machines. However, it is the most difficult to characterize and control.

It is an advantage of the present invention to provide an acoustic suppression arrangement for a component that undergoes induced vibration.

It is an advantage of the present invention to provide damping by creating joints between a panel portion of a component and a containment plate that are springloaded by snap-fit connections, whereby the snap-fit connections elastically preload the joint to provide constant joint preload, required for consistent damping properties, independent of age and temperature.

Other advantages of the present invention will become more apparent to those skilled in the art from a reading of the following detailed description and reference to the drawings.

BRIEF DESCRIPTION OF DRAWINGS

1.

2.

3.

4.

5.

6.

7.

8.

9.

10.

11.

12.

DETAILED DESCRIPTION

Figure 1:
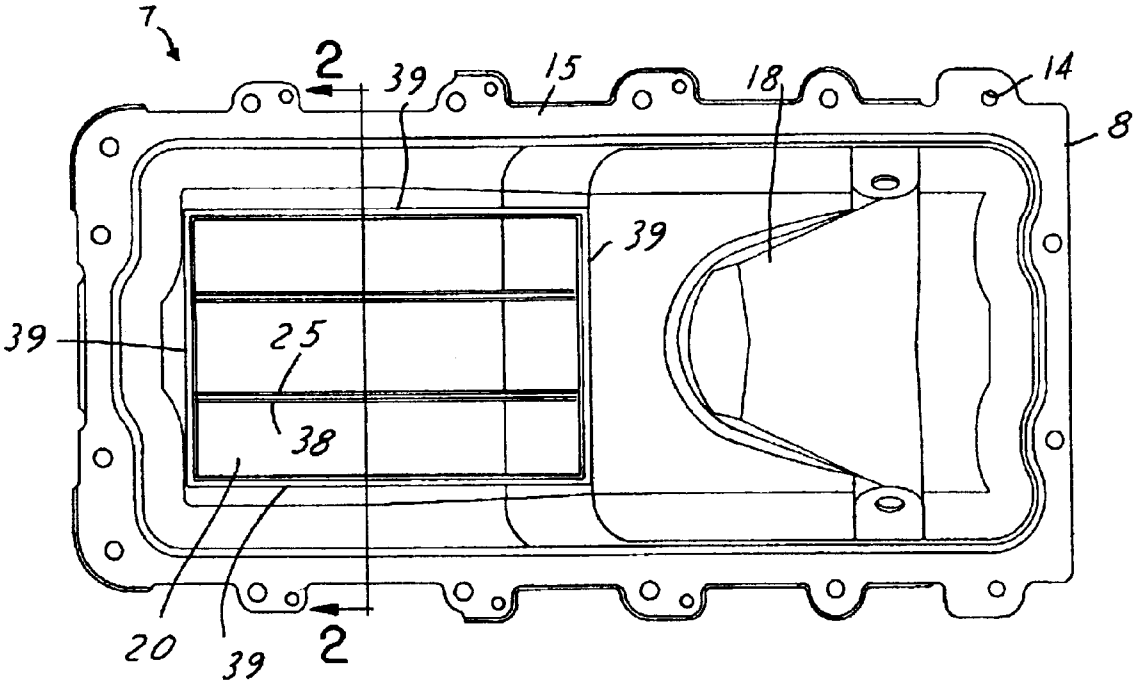
FIG. 1 is a bottom elevational view of an oil pan according to the present invention.
Figure 2:
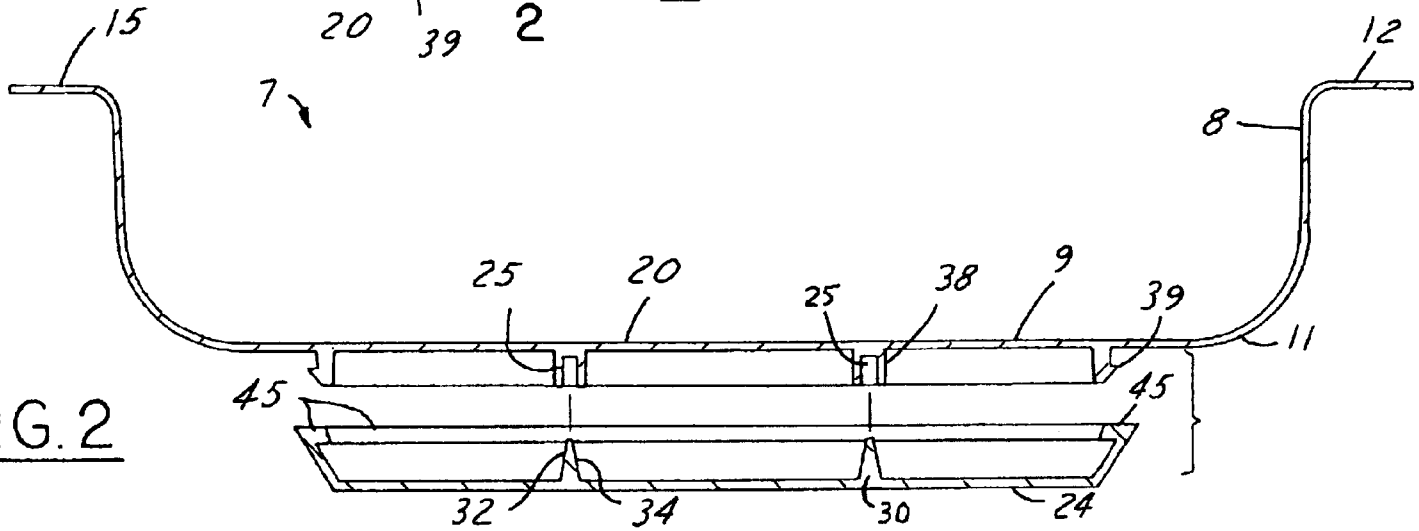
FIG. 2 is a view taken along line 2—2 of FIG. 1, with the addition of a containment plate according to the present invention.
Figure 3:
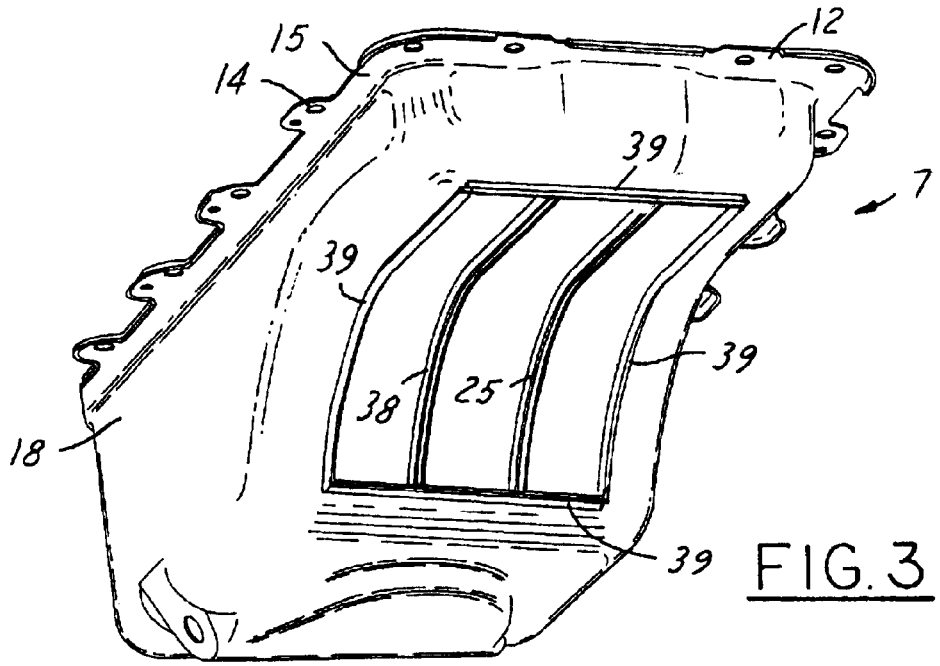
FIG. 3 is a perspective view of the oil pan shown in FIGS. 1–2.

FIGS. 1–3 show an acoustic suppression arrangement of an oil pan 7 according to a preferred environment of the present invention. The oil pan 7 has a component body 8. The oil pan body 8 has an interior surface 9 and an exterior surface 11. Typically the interior surface 9 will form part of a sealed fluid control volume for the lubricating oil utilized in conjunction with operation of the engine (not shown). The oil pan body 8 can be made from a metal or a polymeric material such as injection molded or blow molded plastic. The plastic can optionally be reinforced by a fiber material. The oil pan body 8 has a perimeter flange portion 12. The flange portion 12 has a plurality of apertures 14 to allow the oil pan to be connected by fasteners (not shown) underneath the vehicle engine. The flange portion 12 has a flat region 15 for placement of a gasket (not shown). The oil pan body 8 has a trough to provide a fluid reservoir 18. The oil pan body 8 exterior surface 11 also has a panel portion 20. The panel portion 20 is typically flat or gently curvilinear.

Having a generally parallel spaced relationship from the oil pan body 8 is a containment plate 24. The containment plate 24 can be made of various materials but is typically made from the same material as the oil pan body 8.

Connected to the panel portion 20 is a first projector 25. The first projector 25 is preferably integral with the oil pan panel portion 20. The first projector 25 is linear and extends toward the containment plate 24. Connected to the containment plate 24 is a second projector 30. The second projector 30 is integrally formed and extends toward the oil pan panel portion 20. The second projector 30 has a first inclined surface 32 and an opposing second inclined surface 34.

Parallel spaced from the first projector 25 is a third projector 38. The oil pan body 8 also has integrally connected thereto linear row hooks 39. The hooks encircle the panel portion 20. The third projector 38 makes contact with inclined surface 34. The first projector 25 makes contact with inclined surface 32. The containment plate 24 has perimeter linear hooks 45. The hooks 39, 45 interlock to allow the containment plate 24 to have a flexible snap fit connective engagement with the oil pan body 8.

The first projectors 25 are ideally placed along the portion of the oil pan body 8 having maximum vibratory amplitude and will accordingly stiffen the body 8.

The third projectors 38 can optionally be added to the containment plate 24. However, in most applications it will be more advantageous to add the third projectors to the component body which experiences the vibration. The combination of the first and third projectors 25, 38 on the oil pan body 8 stiffens the oil pan body 8 and retains the polymeric weight advantage while reducing or eliminating the lower frequency modes of vibration.

When connected to the oil pan body 8, the containment plate 24 defines a sealed enclosed space between the containment plate 24 and the oil pan body 8. The sealed space contains the air set forth in motion by vibration of the oil pan body 8. Accordingly, the containment plate 24 becomes a barrier to sound transmission.

Additionally, the flexible attachment of the containment plate 24 to the oil pan body 8 by snap fit connective engagement causes an interference fit between the projectors 25, 30, 38 resulting in an elastic deformation of the projectors. When the oil pan body 8 is undergoing vibration, a portion of the energy created by the oil pan body 8 vibration is dissipated in friction between the projectors, 25, 30, 38 rather than being transmitted to the surrounding air. Accordingly, noise generation by the oil pan body 8 is acoustically suppressed. Hooks 39, 45 also dissipate vibratory energy.

Figure 4:
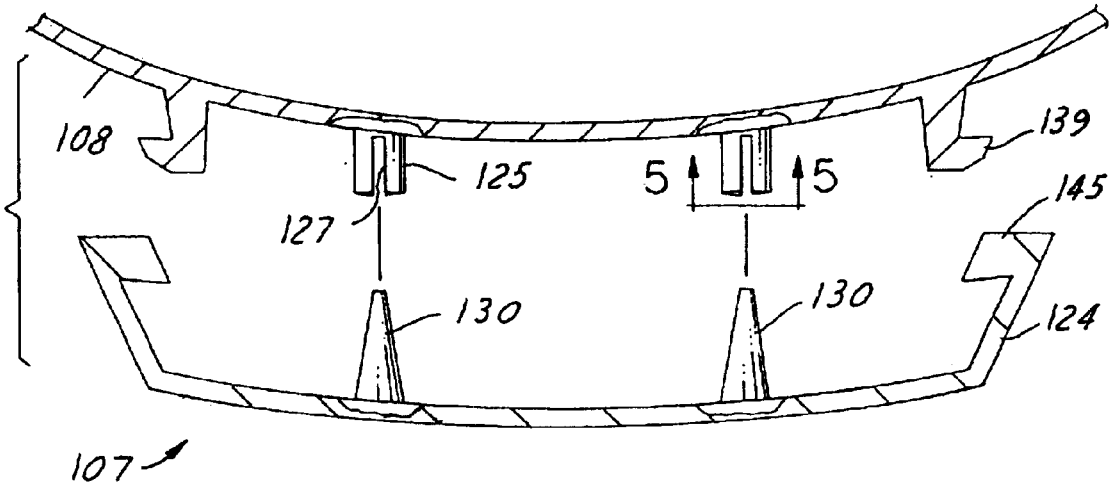
FIG. 4 is a view similar to FIG. 2, of an alternate preferred embodiment featuring an oil pan.
Figure 5:
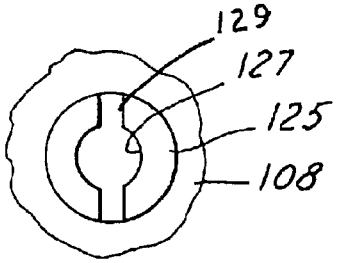
FIG. 5 is a view taken along line 5—5 of FIG. 4.

Turning to FIGS. 4–5, an alternative preferred embodiment of the present invention is shown. An oil pan arrangement 107 includes an oil pan body 108. The oil pan body 108 has a series of geometrically aligned cylindrical projectors 125. The cylindrical projectors 125 have cylindrical coaxial holes 127 that are intersected by transverse slots 129. A containment plate 124 has extending therefrom a series of conical head projectors 130. The conical projectors 130 are received into the cylindrical holes 127 of the first projectors 125. Hooks 139 and 145 connect the containment plate 124 to the oil pan body 108.

Figure 6:
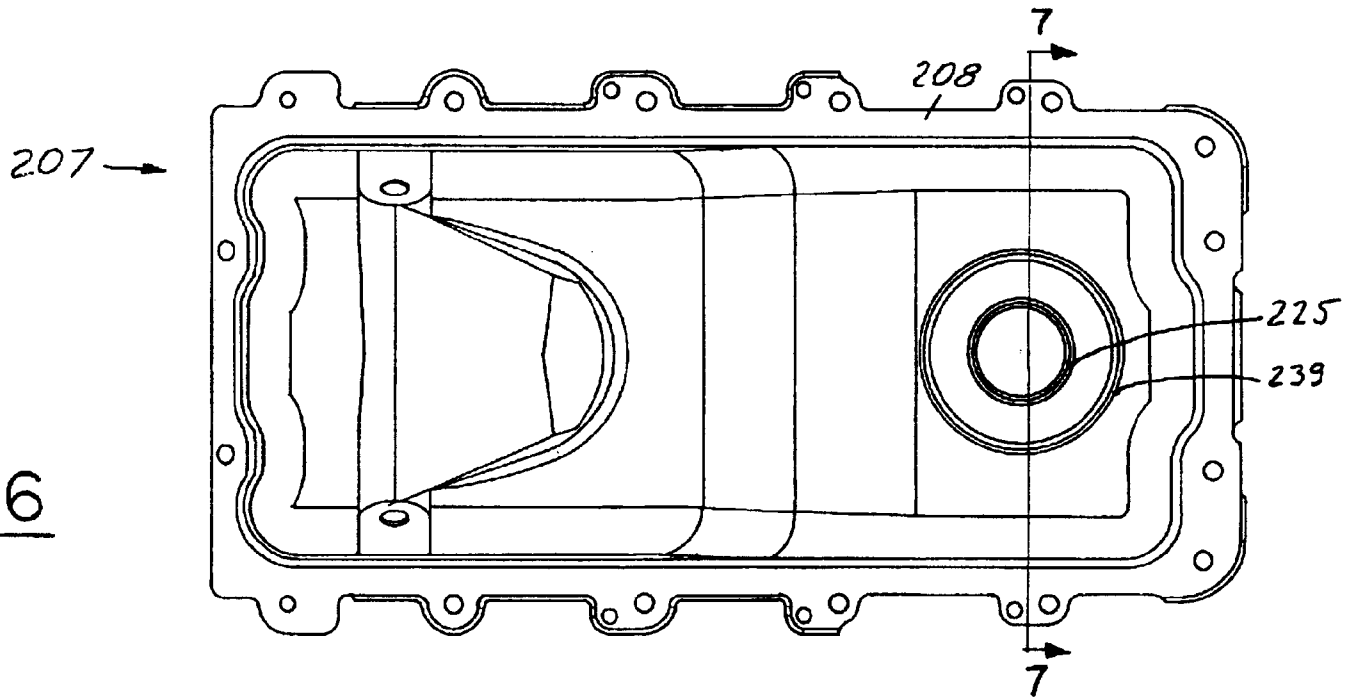
FIG. 6 is a view similar to FIG. 1 of an alternate preferred embodiment oil pan.
Figure 7:
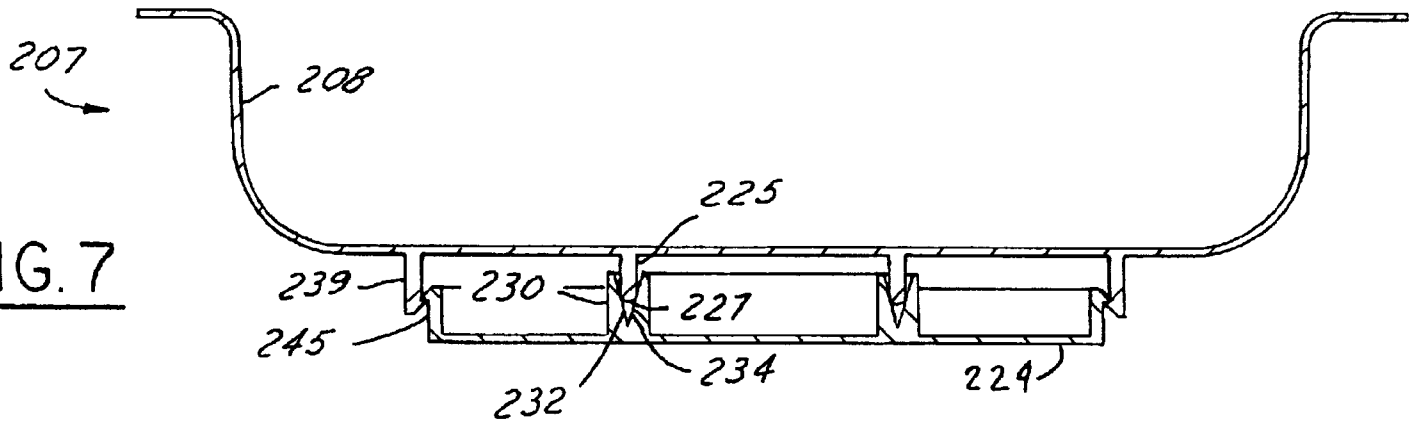
FIG. 7 is a view taken along line 7—7 of FIG. 6 with the addition of a containment plate cover.

FIGS. 6–7 show an oil pan arrangement 207 according to the present invention having an oil pan body 208 and a containment plate 224. Extending from the oil pan body is a circular tower or hollow cylinder to provide first projectors. One first projector 225 is shown in FIG. 6, however, there can be a plurality of concentric or non concentric first projectors if desired. The first projector has a head 227 with a generally wide angle conical cross-sectional shape. The first projector head engages inner 234 and outer 232 conical receptors of a second projector 230 which is connected with the containment plate 224. The containment plate is a circular disk shaped member. The function of the first 225 and second 230 projectors in sound suppression is substantially as aforedescribed. Hooks 145, 239 connect containment plate 224 to the oil pan body 208.

Figure 8:
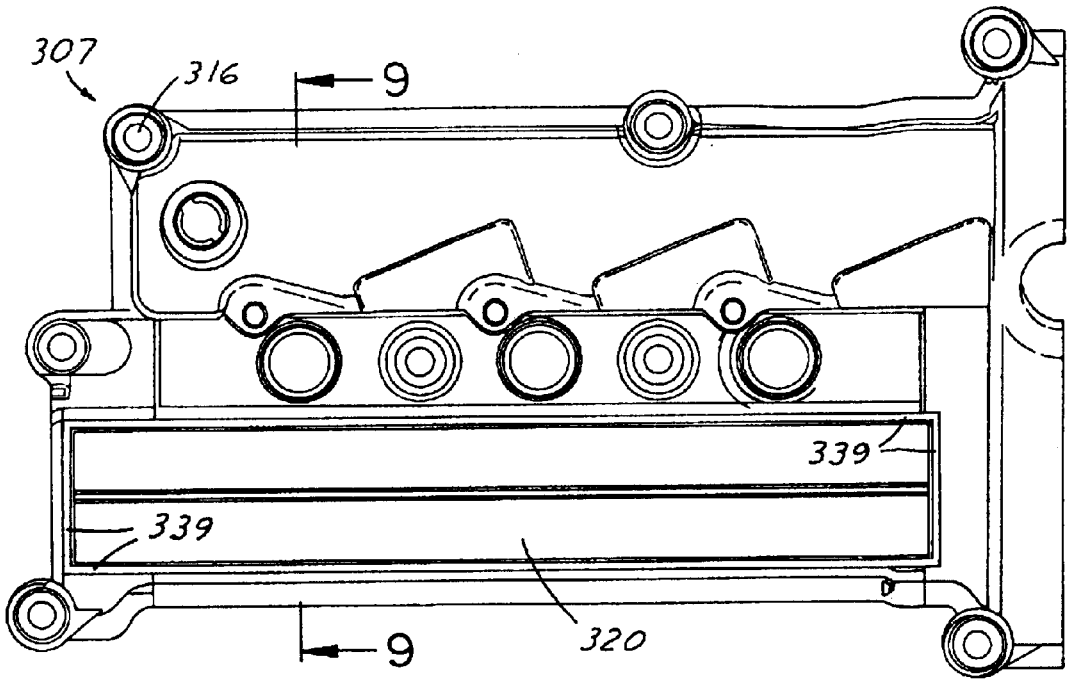
FIG. 8 is a top elevational view of the valve cover according to the present invention.
Figure 9:
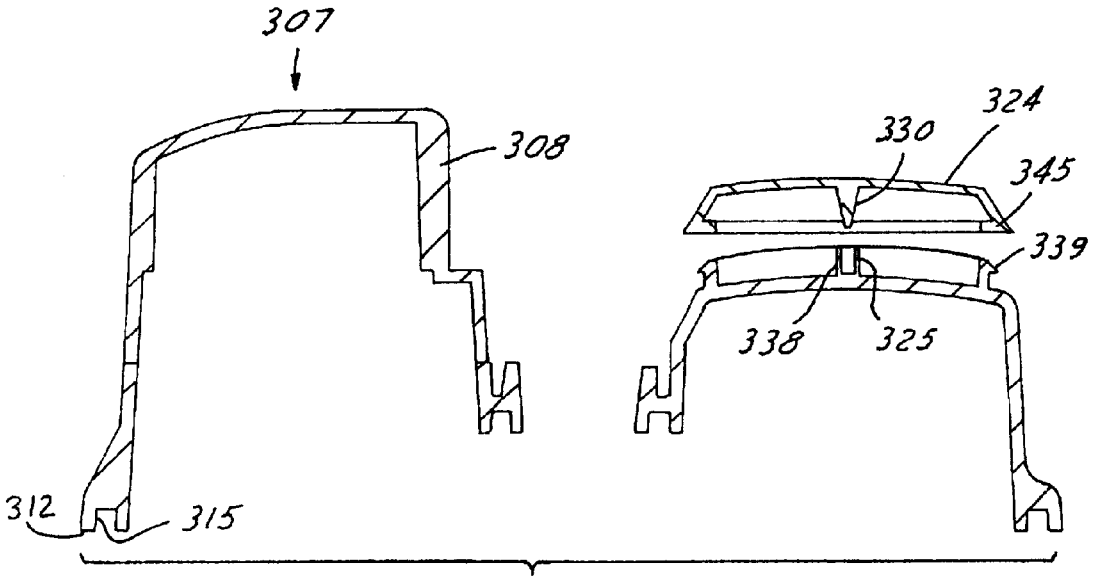
FIG. 9 is a view taken along line 9—9 of FIG. 8.

A valve cover 307 is provided in FIGS. 8–9. The valve cover body 308 can be made from a plastic polymeric material having fiber reinforcement or other suitable materials. The material of the valve cover can be injection molded. The valve cover 307 has an outer periphery 312. The outer periphery 312 has a groove 315 for receipt of a gasket (not shown). The valve cover body 308 also has a series of apertures 316 to allow the valve cover body 308 to be fixably connected upon an engine block. The valve cover body 308 has a panel portion 320. Spaced away from the panel portion 320 is a containment plate 324. First and third projectors 325, 338 similar to those aforedescribed are connected with the valve cover body 308. A second projector 330 is connected with the containment plate 324. The second projector extends toward the valve cover body 308. The valve cover body 308 and the containment plate 324 have interlocking snap fit hooks 339, 345 to place the first and third projectors 325, 338 in an interference fit with the second projector 330. Acoustic suppression is accomplished substantially as aforedescribed.

Figure 10:
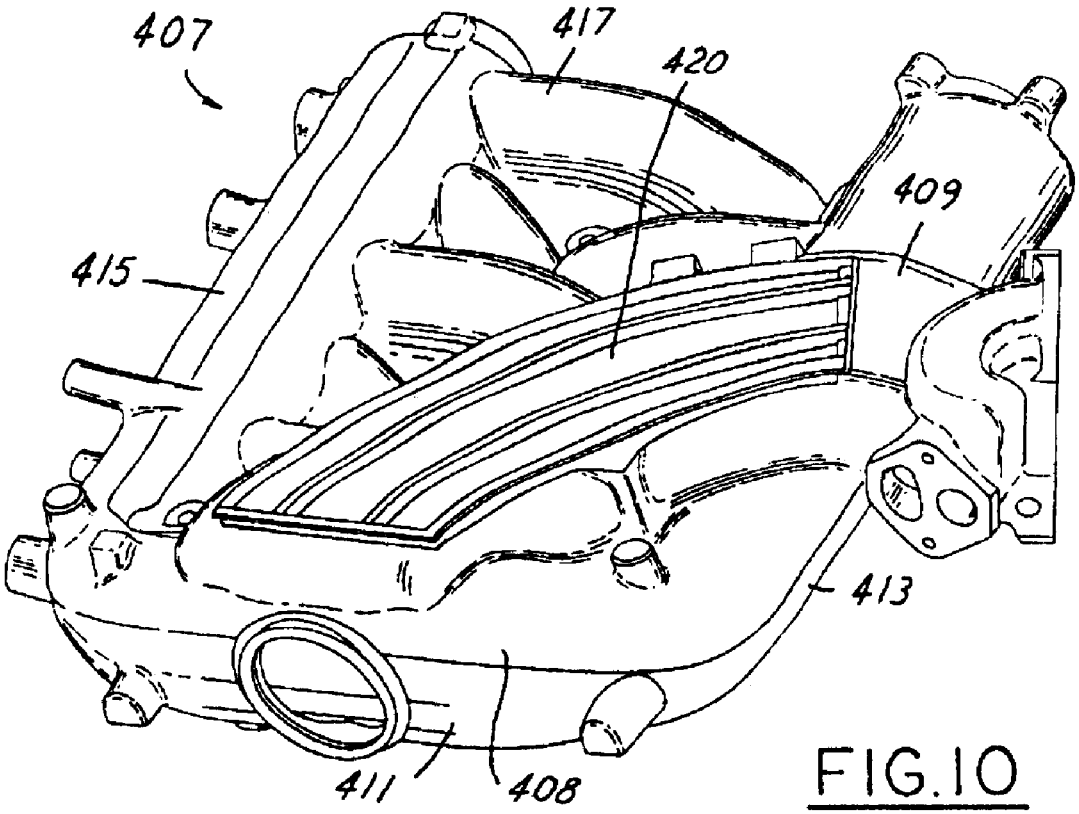
FIG. 10 is a perspective view of an intake air manifold according to the present invention.
Figure 11:
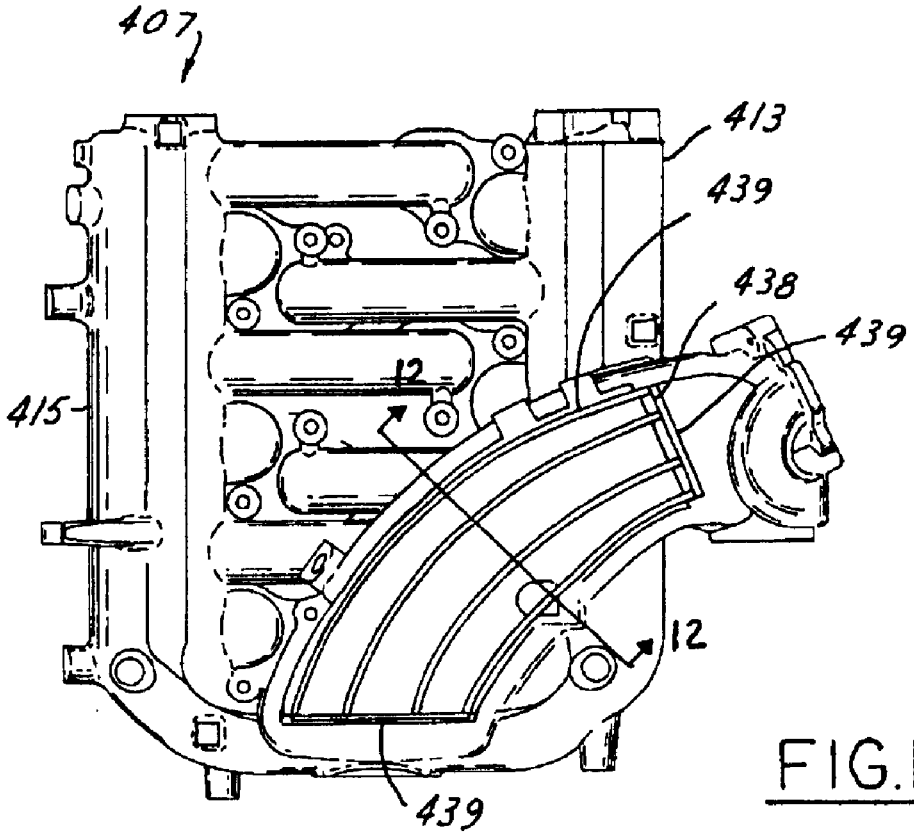
FIG. 11 is a top elevational view of the intake manifold shown in FIG. 10.
Figure 12:
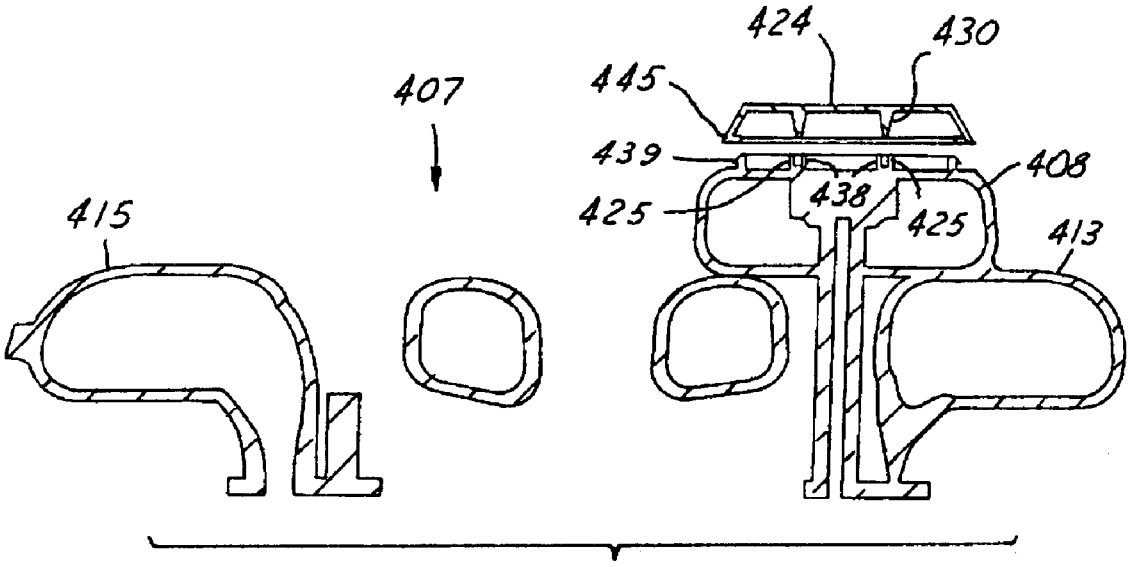
FIG. 12 is a sectional view taken along line 12—12 of FIG. 11.

Referring to FIGS. 10–12, an intake manifold arrangement 407 is provided. The intake manifold has a body 408 fabricated from a polymeric material such as blow molded high temperature plastic, reinforced by a fiber material. The intake manifold body 408 has an inlet 409 that connects to a plenum 411. The plenum 411 splits into right and left arms 413, 415. The arms have a series of runners 417 connecting the arms with the respective engine combustion cylinders. The intake manifold body 408 along inlet 409 has a panel portion 420. The panel portion has connected thereto first and third projectors 425, 438 substantially as previously described. Parallel spaced from panel portion 420 is a containment plate 424. The containment plate has a second projector 430. Connective hooks 439 and 445 connect the containment plate 424 to the intake manifold body 408. The containment plate 424 functions substantially as previously described for the oil pan containment plate 24.

While preferred embodiments of the present invention have been disclosed, it is to be understood that they have been disclosed by way of example only and that various modifications can be made without departing from the spirit and scope of the invention as is defined by the following claims.

What is claimed is:

1. An acoustic suppression arrangement for a component undergoing induced vibration comprising:

a component body having an interior surface and an exterior surface, said exterior surface having a panel portion;

a containment plate having a spaced relationship from said panel portion;

a first projector connected with said component body panel portion and extending toward said containment plate;

a second projector connected with said containment plate and extending toward said component body; and a connector system for connecting said containment plate to said component body panel portion while placing said first and second projectors in an interference fit with respect to one another whereby vibratory energy of said component body is dissipated by frictional contact between said first and second projectors.

2. An arrangement as described in claim 1 wherein said containment plate is connected to said component body along a perimeter of said containment plate.

3. An arrangement as described in claim 1 wherein said connector system seals space between said component body and said containment plate.

4. An arrangement as described in claim 1 wherein said connector system has a snap fit.

5. An arrangement as described in claim 4 wherein said connector system has interlocking hook portions.

6. An arrangement as described in claim 1 wherein vibratory energy of said component body is dissipated by frictional contact of said connector system.

7. An arrangement as described in claim 1 additionally having a third projector connected with one of said component body and said containment plate, and said third projector has frictional contact with said projector connected on said other component body and said containment plate.

8. An arrangement as described in claim 1 wherein one of said projectors has a conical head received in a conical receiver on said other projector.

9. An arrangement as described in claim 1 wherein one of said projectors has a conical head received in a hole in said other projector.

10. An arrangement as described in claim 1 wherein said projectors are linear.

11. An arrangement as described in claim 1 wherein said component body is made from a polymeric material.

12. An arrangement as described in claim 1 wherein said containment plate is made from a polymeric material.

13. An arrangement as described in claim 1 wherein said containment plate is made from a metal material.

14. An arrangement as described in claim 12 wherein said component body is made from a polymeric material.

15. An arrangement as described in claim 1 wherein said component body is made from a metal material.

16. An arrangement as described in claim 1 wherein said component body is an internal combustion engine component.

17. An arrangement as described in claim 16 wherein said component is an intake manifold.

18. An arrangement as described in claim 17 wherein said intake manifold is made from a polymeric material.

19. An arrangement as described in claim 16 wherein said component body is an engine oil pan.

20. An arrangement as described in claim 19 wherein said oil pan is made from a polymeric material.

21. An arrangement as described in claim 16 wherein said component body is a valve cover.

22. An arrangement as described in claim 21 wherein said valve cover is made from a polymeric material.

23. An arrangement as described in claim 16 wherein said engine component is made from a polymeric material.

24. An arrangement as described in claim 23 wherein said component body interior forms a portion of a fluid control volume of said engine.

25. An acoustic suppression arrangement for a component undergoing induced vibration comprising:

a polymeric component body having an interior surface and an exterior surface, said exterior surface having a panel portion;

a polymeric containment plate having a spaced relationship from said panel portion;

a first linear projector connected to said component body panel portion and which extends toward said containment plate;

a second linear projector connected to said containment plate and which extends toward said component body; and a connector system for connecting said containment plate to said component body panel portion while placing said first and second projectors in an interference fit, said connector system including snap fit interlocking linear hooks on said component body and said containment plate, sealing a space between said component body and said containment plate and whereby vibratory energy of said component body is dissipated by frictional contact between said first and second projectors and said hooks.

26. A method of acoustically suppressing a component which undergoes induced vibration comprising:

providing a panel portion on an exterior side of a body of said component;

spacing away from said component body a containment plate having a fixed space relationship with respect to said panel portion;

connecting with said component body panel portion a first projector extending toward said containment plate;

connecting a second projector with said containment plate and extending said second projector toward the first projector to have engagement with said first projector; and connecting said containment plate with said component body panel portion while placing said first and second projectors in an interference fit whereby vibratory energy of said component body is damped by frictional contact between said first and second projectors.

27. The method of claim 26 further comprising connecting a third projector with one of said component body and said containment plate to make frictional engagement with said projector on said other component body and said containment plate.

* * * * *